US005650689A

United States Patent [19]

Itoh et al.

[11] Patent Number: 5,650,689

[45] Date of Patent: Jul. 22, 1997

[54] VACUUM AIRTIGHT DEVICE HAVING NBN ELECTRODE STRUCTURE INCORPORATED THEREIN

[75] Inventors: Shigeo Itoh; Teruo Watanabe; Kazuhiko Tsuburaya; Yoshihiko Hirata, all of Mobara; Susumu Takada; Hiroshi Nakagawa, both of Tsukuba, all of Japan

[73] Assignees: Futaba Denshi Kogyo K.K., Mobara; Agency of Industrial Science and Technology, Tsukuba, both of Japan

[21] Appl. No.: 598,420

[22] Filed: Feb. 8, 1996

[30] Foreign Application Priority Data

Feb. 10, 1995 [JP] Japan ..... 7-045115

[51] Int. Cl.[6] ..... H01J 1/02; H01J 1/16; H01J 19/10; H01J 1/14

[52] U.S. Cl. ..... 313/310; 313/309; 313/336; 313/346 R; 313/351

[58] Field of Search ..... 313/257, 291, 313/306, 309, 311, 336, 346 R, 351, 495

[56] References Cited

U.S. PATENT DOCUMENTS

| | | | |
|---|---|---|---|
| 5,189,341 | 2/1993 | Itoh et al. | 313/309 X |
| 5,256,936 | 10/1993 | Itoh et al. | 313/495 |
| 5,319,279 | 6/1994 | Watanabe et al. | 313/309 |
| 5,381,069 | 1/1995 | Itoh et al. | 313/310 |
| 5,402,041 | 3/1995 | Kishino et al. | 315/169.1 |
| 5,448,133 | 9/1995 | Ise | 313/309 X |
| 5,469,014 | 11/1995 | Itoh et al. | 313/308 |

*Primary Examiner*—Sandra L. O'Shea
*Assistant Examiner*—Mack Haynes
*Attorney, Agent, or Firm*—Oblon, Spivak, McClelland, Maier & Neustadt, P.C.

[57] ABSTRACT

A field emission element including an electrode structure made of a thin film exhibiting increased adhesive strength. A thin film of niobium nitride (NbN) is formed on a glass substrate by sputtering or the like. The NbN film exhibits increased adhesive strength to a degree sufficient to prevent etching for formation of the film into electrodes from causing peeling of the film.

6 Claims, 6 Drawing Sheets

VACUUM AIRTIGHT DEVICE HAVING NBN ELECTRODE STRUCTURE INCORPORATED THEREIN

BACKGROUND OF THE INVENTION

This invention relates to a vacuum airtight element having a metal film electrode structure arranged in a vacuum airtight envelope, such as a field emission cathode used as an electron source for a display device or the like, and more particularly to a vacuum airtight element wherein at least a part of an electrode structure is formed of niobium nitride (NbN).

A field emission element having a field emission cathode incorporated therein has been conventionally known as one example of a vacuum hermetic element in the art. Now, a conventional vacuum airtight element will be described with reference to a field emission element by way of example.

When an electric field set at about $10^9$ (V/m) is applied to a surface of a metal material or that of a semiconductor material, a tunnel effect permits electrons to pass through a barrier, resulting in the electrons being discharged to a vacuum even at a normal temperature. Such a phenomenon is referred to as "field emission" as conventionally known in the art and a cathode constructed so as to emit electrons based on such a principle is referred to as "field emission cathode".

Recent development of fine processing techniques for a semiconductor permits a field emission cathode to be formed into a size as small as microns. The development permit number of such field emission cathodes to be formed on a substrate, resulting in providing a field emission element of the surface emission type. It is proposed that the field emission element thus provided is used as an electron source for a display device, a CRT, an electron microscope, an electron beam device.

Such a conventional field emission element will be more detailedly described hereinafter with reference to FIGS. 7 and 8. The field emission element includes a field emission cathode formed on a glass substrate 101. Application of the field emission element to a display device is carried out by arranging the glass substrate 101 in a manner to be opposite to a phosphor deposited anode substrate of a transparent glass material and spaced therefrom at a predetermined interval, to thereby form an airtight envelope, which is then evacuated to a high vacuum.

The field emission cathode formed on the glass substrate 101 is constructed of stripe-like cathode line electrodes 102 formed by sputtering or the like, a resistive layer 103 formed on the cathode line electrodes 102, a plurality of emitter cones 106 formed on the resistive layer 103, and gate line electrodes 105 formed in proximity to the emitter cones 106 so as to surround a tip end of each of the emitter cones 106, resulting in being a field emission array of the Spindt-type.

The above-described resistive layer 103 is laminatedly formed thereon with an insulating layer 104, on which the gate line electrodes 105 are then formed.

The emitter cones 106 may be formed while keeping a pitch between each adjacent two of the emitter cones 106 at a level as small as 10 microns or less, so that tens of thousands to hundreds of thousands of such emitter cones thus formed are arranged on one glass glass plate 101. In the field emission element thus constructed, a distance between a gate and a cathode is kept at a level as small as a sub-micron, so that application of a voltage $V_{GE}$108 as low as tens of volts between the gate and the cathode permits electrons to be emitted from the emitter cones 106.

Application of the field emission element to a display device is carried out in such a manner that the anode substrate arranged opposite to the glass substrate 101 is formed thereon with an anode electrode, on which a phosphor is laminatedly deposited in a dot-like pattern.

Thus, application of a positive voltage to the anode electrode causes electrons emitted from the emitter cones 106 to be captured by the anode electrode, so that the electrons impinge on the dot-patterned phosphor laminated on the anode electrode, resulting in exciting the phosphor, leading to luminescence of the phosphor. The luminescence may be observed through the transparent anode substrate.

The emitter cones 106 are arranged on the above-described plural cathode line electrodes 102 arranged in a stripe-like manner on the glass substrate 101 and the plural gate line electrodes 105 are arranged in a stripe-like manner and so as to extend in a direction perpendicular to the cathode line electrodes 102.

Thus, the stripe-like cathode line electrodes 102 and stripe-like gate line electrodes 105 cooperate with each other to define a matrix, which is scanned by a cathode scanning section (not shown) and a gate scanning section (not shown).

This causes electrons to be selectively emitted from the emitter cones 106 depending on an image signal, resulting in a corresponding portion of the dot-patterned phosphor emitting light, so that an image may be displayed on the anode substrate.

In this instance, for example, an image signal is applied to the gate scanning section, so that an image for one sheet is displayed on the anode substrate when scanning for one field terminates.

In the conventional field emission element, the cathode line electrodes 102 and gate line electrodes 105 are formed on the glass substrate 101 and insulating layer 104 by sputtering or the like, respectively. In general, the cathode line electrodes 102 and gate line electrodes 105 each are made of a high-melting material such as niobium (Nb), molybdenum (Mo), tantalum (Ta), tungsten (W) or the like. Thus, the conventional flied emission element causes disadvantages.

For example, in the conventional field emission element, a thin film 111 of high-purity niobium is formed on the glass substrate 110 by sputtering as shown in FIG. 9. Then, the film. 111 is subject to dry etching such as RIE or the like, to thereby be formed into a stripe-like configuration, resulting in the cathode line electrodes 102 being formed. However, this causes etching marks to be left on the glass substrate 110, so that it is required to remove the marks by somewhat dissolving a surface of the glass substrate 110 by a depth δ shown in FIG. 10 by means of hydrofluoric acid.

Unfortunately, this causes hydrofluoric acid to enter an interface between the glass substrate 110 and the thin film 111 of high-purity niobium because the thin film 111 of Nb fails to exhibit satisfactory bond or adhesion strength to the glass substrate 110, leading to peeling of the thin film 111 of Nb from the glass substrate 110, resulting in a film peel region occurring as shown in FIG. 10.

Such a film peel region causes performance or characteristics of the field emission element to be highly deteriorated, leading to a decrease in yields of the element.

Also, the thin film of high-purity niobium is readily subject to oxidation, to thereby form niobium oxide ($NbO_2$). The niobium oxide is decreased in etching speed as compared with niobium. Unfortunately, this causes an important disadvantage of the field emission element.

More particularly, supposing that a thin cathode film 121 for cathode line electrodes is formed on a glass substrate 120 and then an insulating layer 122 of $SiO_2$ and a thin film 123 of Nb are formed on the cathode film 121 in order, a surface 124 of the Nb film 123 is oxidized by oxygen contained in an ambient atmosphere and a boundary surface of the Nb film 123 bordering the insulating layer 122 is oxidized by oxygen contained in $SiO_2$.

Then, when etching is carried out on the Nb film 123 to provide the Nb film 123 with openings, to thereby form the Nb film 123 into gate line electrodes, the Nb film 123, as shown in FIG. 12, is etched in such a manner that holes are bored in a central region of the film 123, resulting in the openings each being formed into a barrel-like shape in section because niobium is increased in etching speed as compared with niobium oxide.

Formation of such a barrel-like opening renders fine patterning difficult, so that an increase in degree of integration is failed.

In general, a thin film of Nb is readily subject to oxidation, to thereby cause an increase in surface charging. Thus, in the conventional field emission element, when the gate line electrodes are oxidized, an electric field formed between the gate like electrodes and the emitter cones is decreased, so that the emitter cones fail to satisfactorily emit electrons.

SUMMARY OF THE INVENTION

The present invention has been made in view of the foregoing disadvantage of the prior art.

Accordingly, it is an object of the present invention to provide a field emission element which has electrodes formed of a film made of high-melting metal exhibiting increased adhesion strength.

It is another object of the present invention to provide a field emission element provided with electrodes capable of permitting fine patterning to be accomplished and reducing surface charging, resulting in exhibiting satisfactory performance or characteristics.

In accordance with the present invention, a vacuum airtight element having a NbN electrode structure incorporated therein is provided. The vacuum airtight element includes a vacuum airtight envelope, and a single-layer electrode means and a multi-layer electrode means arranged in the vacuum airtight envelope. At least one of the single-layer electrode means and multi-layer electrode means has a surface formed of NbN.

In a preferred embodiment of the present invention, at least one of the electrode means is formed of a thin film of NbN.

In a preferred embodiment of the present invention, at least one of the electrode means includes a thin film of Nb and a thin film of NbN arranged below the Nb film.

In a preferred embodiment of the present invention, at least one of the electrode means includes a thin film of Nb and thin films of NbN arranged so as to interpose the Nb film therebetween.

Also, in accordance with the present invention, a vacuum airtight element having a NbN electrode structure incorporated therein is provided. The vacuum airtight element includes cathode line electrodes formed on a cathode substrate, an insulating layer formed on the cathode line electrodes, and gate line electrodes formed on the insulating layer. The insulating layer and gate line electrodes are formed with common openings. The vacuum airtight element also includes emitter cones formed on the cathode line electrodes while being arranged in said openings. The gate line electrodes are formed of a thin film of Nb and subject to a nitriding treatment after formation of the openings and prior to formation of the emitter cones.

In a preferred embodiment of the present invention, a resistive layer is formed on the cathode line electrodes.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein;

FIG. 2(*b*) is a schematic view showing a crystalline state of a thin film of niobium (Nb) formed on a glass substrate;

DETAILED DESCRIPTION OF THE PREFERRED EMBODIMENTS

Now, a vacuum airtight element according to the present invention will be described hereinafter with reference to FIGS. 1 to 6.

Figure 1:
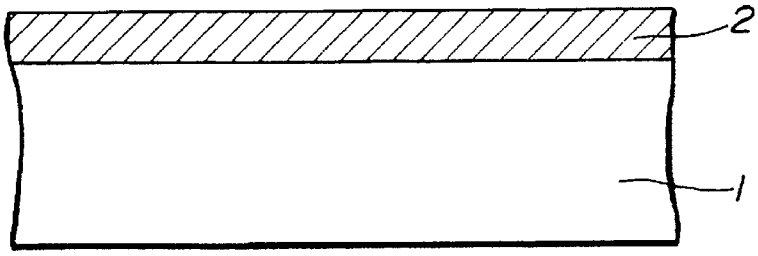
FIG. 1 is a schematic view showing formation of a thin film of niobium nitride (NbN) on a glass substrate in a field emission element which is a first embodiment of a vacuum airtight element having a NbN electrode structure incorporated therein according to the present invention.

Referring first to FIG. 1, an essential part of a field emission element which is an embodiment of a vacuum airtight element having a NbN electrode structure incorporated therein according to the present invention is illustrated.

Figure 8:
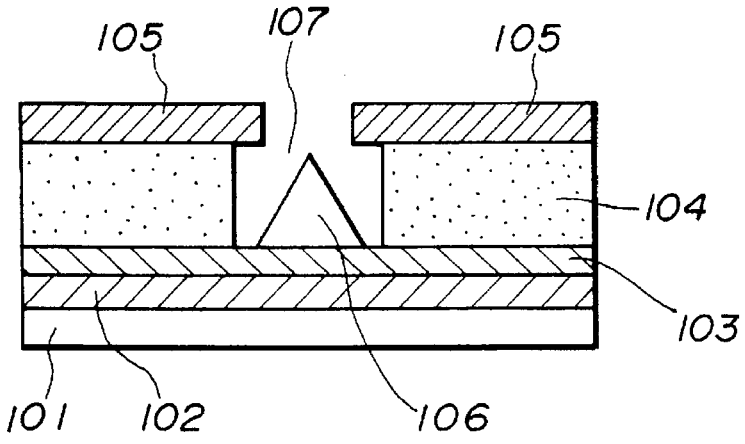
FIG.8 (PRIOR ART)
FIG. 8 is a schematic sectional view of the conventional field emission element shown in FIG. 7.
Figure 9:
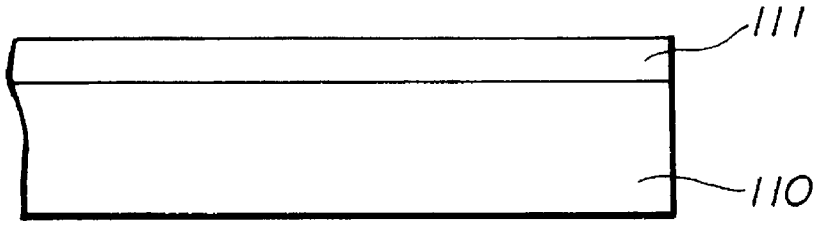
FIG.9 (PRIOR ART)
FIG. 9 is a schematic view showing an electrode structure of a conventional field emission element.
Figure 10:
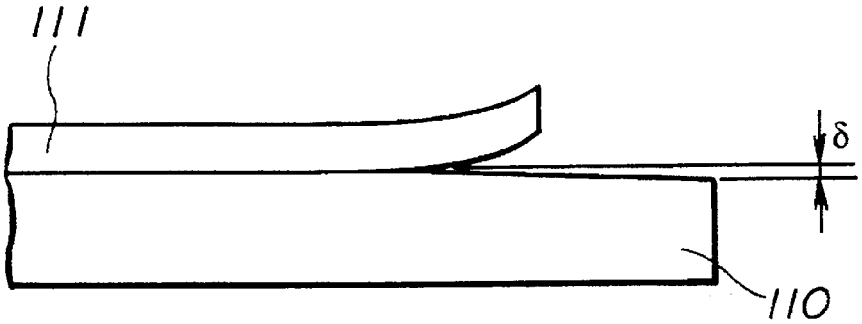
FIG.10 (PRIOR ART)
FIG. 10 is a schematic view showing results of etching of a thin film of niobium (Nb) formed on a glass substrate in a conventional field emission element.
Figure 11:
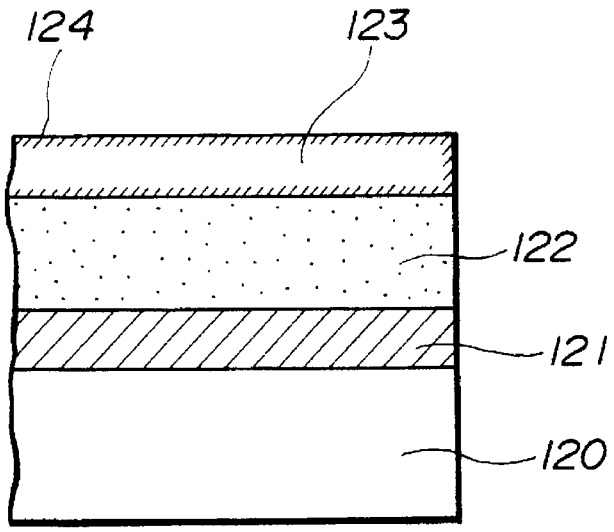
FIG.11 (PRIOR ART)
FIG. 11 is a schematic view showing gate line electrodes in a conventional field emission element.
Figure 12:
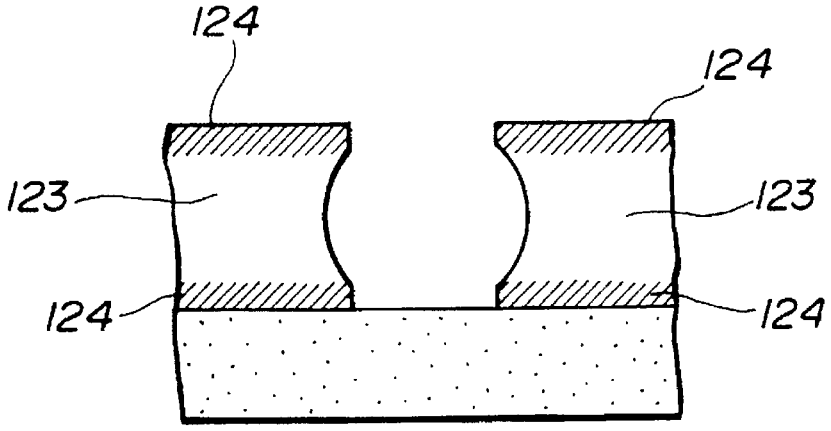
FIG.12 (PRIOR ART)
FIG. 12 is a schematic view showing results of etching carried out on gate line electrodes in a conventional field emission element for providing the gate line electrodes with openings.

In a vacuum airtight element of the illustrated embodiment in the form of a field emission element, as shown in FIG. 1, a glass substrate 1 is formed thereon with a thin film 2 of niobium nitride (NbN) by sputtering or the like, followed by patterning by photolithography, resulting in providing cathode line electrodes. Also, the cathode line electrodes are formed thereon with a resistive layer in the form of a film, on which a thin film of niobium nitride (NbN) for an insulating layer and gate line electrodes is then formed. Then, the gate line electrodes and insulating layer are form with common openings 107 as in the prior art described above with reference to FIG. 8, followed by formation of emitter cones 107 in the openings.

Now, manufacturing of the cathode line electrodes will be more detailedly described.

First, the glass substrate 1 is washed and then set in a sputtering unit.

Then, a chamber of the sputtering unit is evacuated to a pressure as low as about $3\times10^{-\infty}$Pa, followed by pre-sputtering using argon (Ar).

Thereafter, a mixture obtained by adding nitrogen ($N_2$) gas acting as reactive gas to Ar acting as sputtering gas at a ratio of 1/5 to 1/100 based on Ar is fed to the chamber, to thereby carry out formation of a thin film of $NbN_2$ at a power of about 1.0 kW. A pressure of film formation gas is desirably controlled so that stress of a nitride film or NbN film is reduced to a level approximating zero.

Then, the NbN film thus formed is subject to patterning by photolithography, resulting in a configuration suitable for cathode line electrodes being provided. The patterning is carried out by a process comprising a photoresist application step, an exposure step and a development step practiced in order.

Thereafter, the NbN film is subject to dry etching such as RIE or the like and then etching marks left on the glass substrate 1 are removed by hydrofluoric acid.

Finally, the photoresist is peeled, followed by washing, resulting in the cathode line electrodes being formed.

Now, manufacturing of the cathode line electrodes will be more detailedly described. In the manufacturing, steps extending to formation of a thin film of NbN are carried out in substantially the same manner, therefore, the following description will be made on steps subsequent to formation of the thin film of NbN.

First, the NbN film formed is subject to patterning by photolithography, resulting in a configuration suitable for cathode line electrodes being provided. The patterning is carried out by a process comprising a photoresist application step, an exposure step and a development step practiced in order. This permits the NbN film to be formed with openings.

Then, the NbN film is subject to dry etching such as RIE or the like and then etching marks left are removed by hydrofluoric acid.

Thereafter, the photoresist is peeled, followed by washing, resulting in the gate line electrodes being formed.

Figure 7:
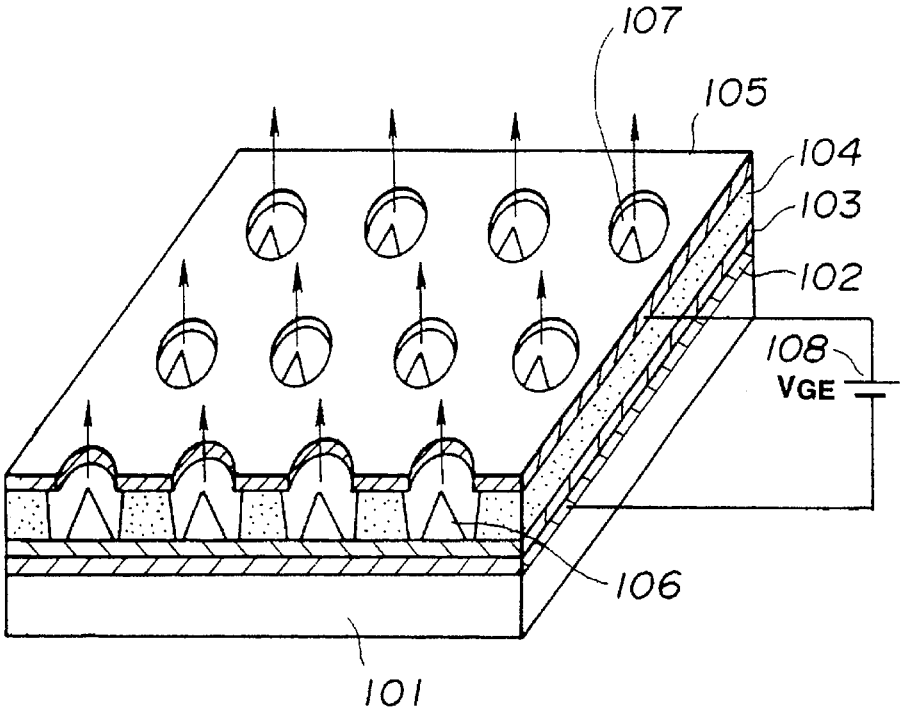
FIG.7 (PRIOR ART)
FIG. 7 is a schematic perspective view showing a conventional field emission element.

Thus, a field emission element constructed in substantially the same manner as that described above with reference to FIGS. 7 and 8 may be manufactured, except that the cathode line electrodes and gate line electrodes each are made of a thin film of NbN.

Figure 2A:
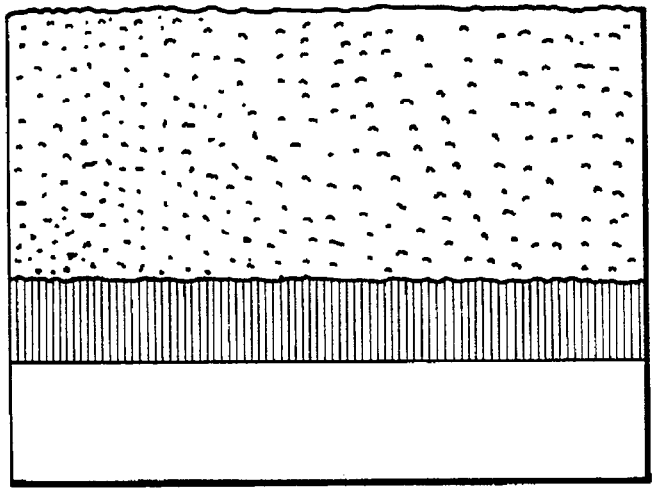
FIG. 2(*a*) is a schematic view showing a crystalline state of a thin film of niobium nitride (NbN) formed on a glass substrate.
Figure 2B:
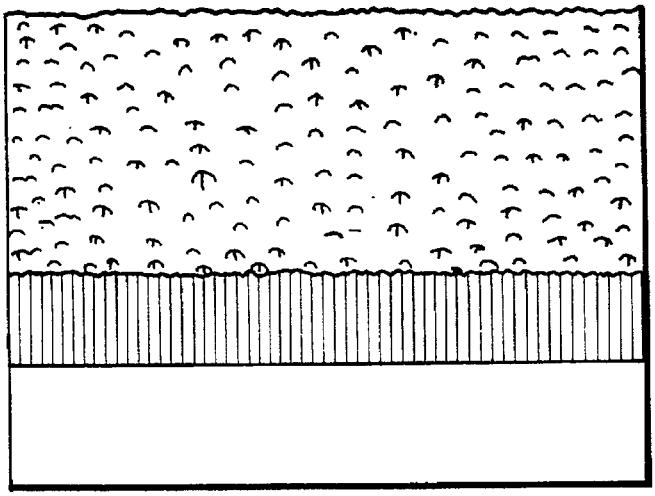

FIG. 2(*a*) is an electron microscope photograph showing a thin film of niobium nitride (NbN) formed on a glass substrate by sputtering and FIG. 2(*b*) is that showing a thin film of Nobium (Hb) formed on a glass substrate by sputtering. Each thin film in FIGS. 2A and 2B is interposed between a substrate layer and a top layer that is composed of an insulative material.

As will be noted from FIGS. 2(*a*) and 2(*b*), the NbN film has a crystalline structure wherein fine columnar crystals are dense, whereas the Nb film is formed of large and thick columnar crystals. Such an increase in adhesion force of the NbN film as compared with the Nb film would be due to denseness of crystals in the NbN film.

Figure 3:
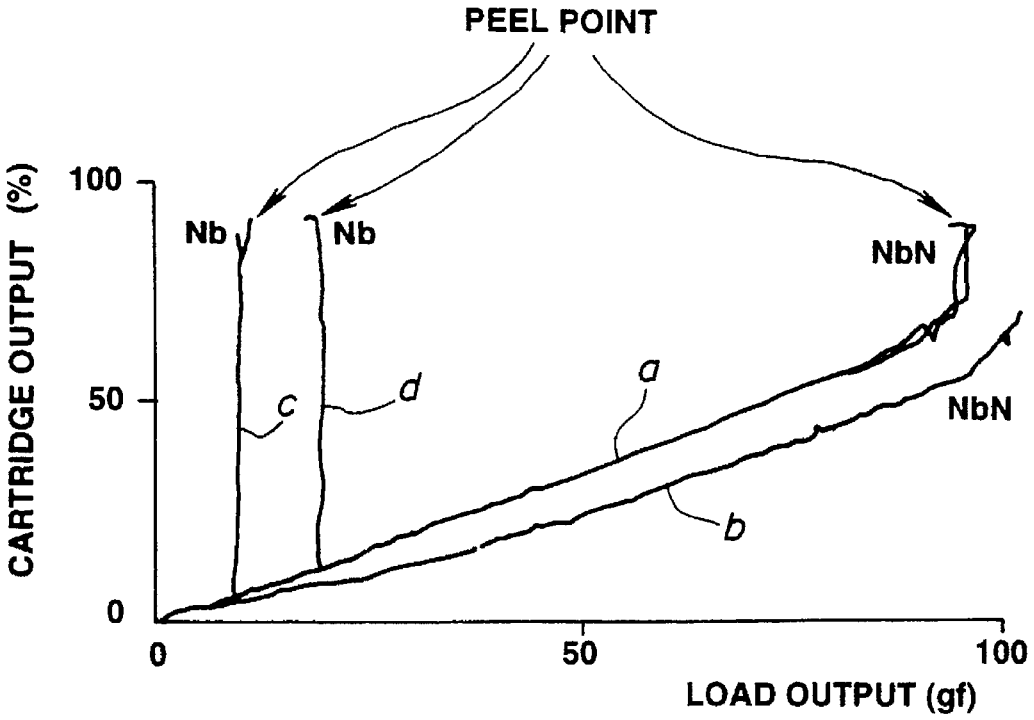
FIG. 3 is a graphical representation showing results of a scratch test carried out for measuring adhesion strength of each of a thin film of niobium nitride (NbN) and a thin film of niobium (Nb)

FIG. 3 shows results of a scratch test carried out for measuring bond or adhesion strength of the thin films. More particularly, FIG. 3 shows strength of adhesion of the Nb film to the glass substrate and that of the NbN film thereto while comparing both with each other. In FIG. 3, a and b indicate results of a scratch test carried on two specimens each having the NbN film formed thereon. In each of both specimens, the NbN film has a peel point exceeding 90 (gf). Also, in FIG. 3, c and d indicate results of a scratch test carried on two specimens each having the Nb film formed thereon. In one of the specimens, the Nb film has a peel point as low as about 10 (gf); whereas the other specimen causes it to have a peel point as low as about 20 (gf). Therefore, it will be noted that the NbN film exhibits adhesion strength five times as large as the Nb film or more.

Figure 4:
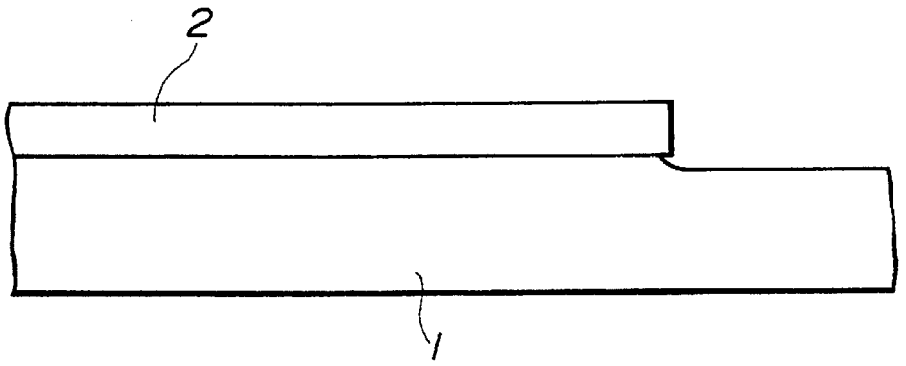
FIG. 4 is a schematic view showing results of an etching treatment carried out on a thin film of niobium nitride (NbN) formed on a glass substrate.

Thus, the treatment with hydrofluoric acid for removing etching marks as shown in FIG. 4 does not cause the NbN film to be peeled from the glass substrate 1, although it somewhat causes etching of the glass substrate 1. Thus, the NbN film permits the field emission element to exhibit improved performance.

NbN has an electric resistance of about 500 (μΩ-cm), which is significantly high as compared with about 10 (μΩ-cm) which is an electric resistance of Nb. However, this does not adversely affect performance of NbN because "microohm" is a highly low unit.

Also, the NbN film is hard to be oxidized, to thereby ensure satisfactory control of etching. Further, it has a dense crystal structure, leading to fine patterning of the film. Thus, the NbN film ensures that an edge portion thereof exhibits improved formability and reproducibility, resulting in being suitably applied to a flat-type field emission element as well.

When the field emission element having the gate line electrodes formed of the NbN film is operated to cause electrons emitted from the emitter cones to impinge on the gate line electrodes, nitrogen ($N_2$) gas is possibly generated from the gate line electrodes. The nitrogen gas adversely affects operation of the field emission element. Thus, it is required to prevent such generation of nitrogen gas.

For this purpose, it is desirable to heat the NbN film to about 600° C. to subject it to annealing after or during formation of the film, leading to removal of $N_2$ gas.

Figure 5:
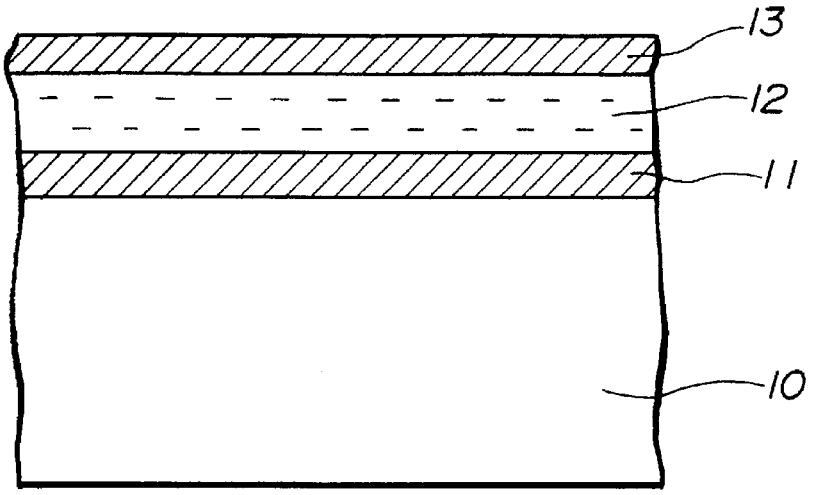
FIG. 5 is a schematic view showing a field emission element which is a second embodiment of a vacuum airtight element having a NbN electrode structure incorporated therein according to the present invention.

Alternatively, this may be accomplished in such a manner as shown in FIG. 5, which shows a second embodiment of a vacuum airtight element according to the present invention in the form of a field emission element. More particularly, in a field emission element of the illustrated embodiment, gate line electrodes are formed on substrate 10 by vertically interposing a thin film of Nb between thin films of NbN. Formation of the thin films in such a manner is carried out by feeding reactive nitrogen gas during sputtering to form the lower NbN 11 and 13 film, stopping feed of the nitrogen gas to form the Nb film and then feeding the gas to form the upper NbN film.

It would be considered that the NbN film is formed only below the Nb film. However, such a structure possibly causes a surface of the Nb film to be oxidized. Thus, in this instance, application of the structure to an electrode of which an upper surface is covered with a resistive layer, an insulating layer or the like as in the cathode line electrodes effectively prevents such oxidation. Also, this provides the cathode line electrodes with increased adhesion strength.

Figure 6:
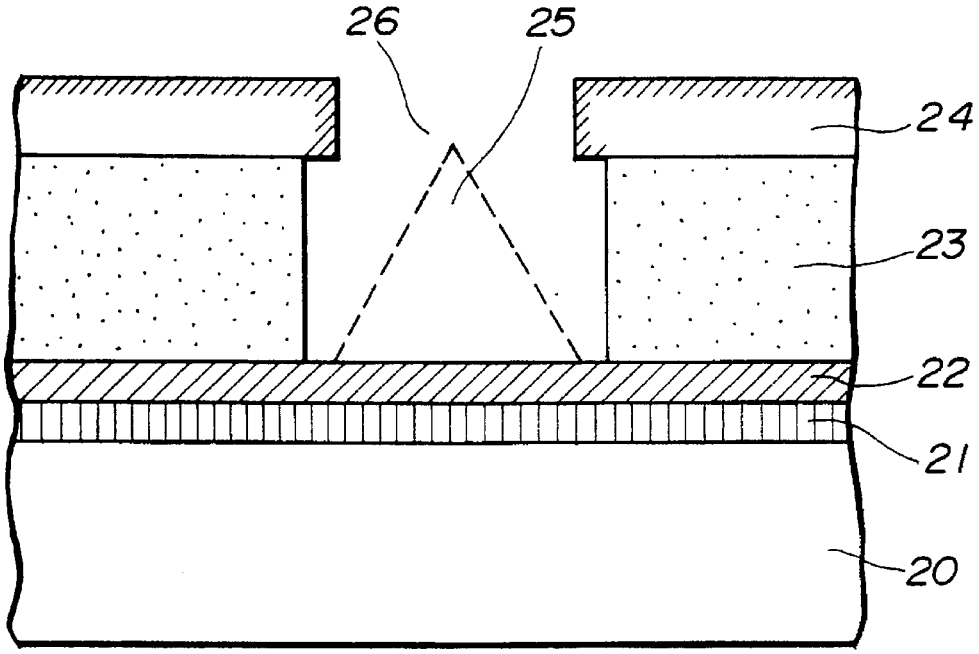
FIG. 6 is a schematic view showing a field mission element which is a third embodiment of a vacuum airtight element having a NbN electrode structure incorporated therein according to the present invention.

Referring now to FIG. 6, a field emission element which is a third embodiment of a vacuum airtight element according to the present invention is illustrated. In a field emission element of the illustrated embodiment, an insulating layer 23 and gate line electrodes 24 are formed with common openings 26. Then, a surface of the gate line electrodes made of a thin film of Nb is subject to nitriding by heating it in a nitrogen gas atmosphere or feeding of nitrogen gas to a plasma atmosphere in which it is placed, to thereby prevent discharge of nitrogen gas from the gate line electrodes due to impingement of electrons thereon. The insulating layer 23 is shown on a resistive layer 22, which is on a cathode line electrode layer 21, which in turn is on a substrate layer 20.

In the embodiments described above, a ratio of reactive gas or nitrogen gas to argon (Ar) is set to be 1/5 to 1/100. However, it is merely required to set the nitrogen gas ratio at a value sufficient to permit the thin film of NbN to be satisfactorily formed. In general, the ratio is varied depending on a pressure, a power of a sputtering unit or the like.

Also, only one of the cathode line electrode group and gate line electrode group may be made of the thin film of NbN.

Further, the embodiments of the present invention have been described in connection with the field emission element. However, the present invention is applicable to a vacuum airtight element of various types other than the field emission element wherein electrodes are arranged in a vacuum airtight envelope.

As can be seen from the foregoing, the vacuum airtight element of the present invention is so constructed that at least one electrode group and desirably both the cathode line electrode group and gate like electrode group are formed of NbN into a configuration like a thin film. Such construction permits adhesion strength of the electrodes to the substrate to be increased to a degree sufficient to prevent removal of etching marks from causing peeling of the films, resulting in yields of the element being significantly increased.

Also, the present invention permits the electrodes to exhibit satisfactory oxidation resistance and have a dense crystal structure, leading to fine patterning. Further, the present invention permits surface charging to be reduced and prevents a decrease in electric field between the emitter cones and the gate line electrodes, so that the vacuum airtight element of the present invention may exhibit improved characteristics and performance.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A vacuum airtight element having a NbN electrode structure incorporated therein, comprising:

a vacuum airtight envelope;

a single-layer electrode means and a multi-layer electrode means arranged in said vacuum airtight envelope;

at least one of said single-layer electrode means and multi-layer electrode means having a surface formed of NbN.

2. A vacuum airtight element as defined in claim 1, wherein at least one of said electrode means is formed of a thin film of NbN.

3. A vacuum airtight element as defined in claim 1, wherein at least one of said electrode means includes a thin film of Nb and a thin film of NbN arranged below said Nb film.

4. A vacuum airtight element as defined in claim 1, wherein at least one of said electrode means includes a thin film of Nb and thin films of NbN arranged so as to interpose said Nb film therebetween.

5. A vacuum airtight element having a NbN electrode structure incorporated therein, comprising:

cathode line electrodes formed on a cathode substrate;

an insulating layer formed on said cathode line electrodes;

gate line electrodes formed on said insulating layer;

said insulating layer and gate line electrodes being formed with common openings;

emitter cones formed on said cathode line electrodes while being arranged in said openings;

said gate line electrodes being formed of a thin film of Nb and subject to a nitriding treatment after formation of said openings and prior to formation of said emitter cones.

6. A vacuum airtight element as defined in claim 5, further comprising a resistive layer formed on said cathode line electrodes.

* * * * *